US006854500B2

(12) United States Patent
Chen et al.

(10) Patent No.: US 6,854,500 B2
(45) Date of Patent: Feb. 15, 2005

(54) FOLDABLE WINDOW BLIND STRUCTURE

(76) Inventors: Shui-Hu Chen, PO. Box 82-144, Taipei (TW); Chi Chung Lai, PO. Box 82-144, Taipei (TW)

( * ) Notice: Subject to any disclaimer, the term of this patent is extended or adjusted under 35 U.S.C. 154(b) by 0 days.

(21) Appl. No.: 10/309,079

(22) Filed: Dec. 4, 2002

(65) Prior Publication Data

US 2004/0108078 A1 Jun. 10, 2004

(51) Int. Cl.[7] ..... A47H 5/00
(52) U.S. Cl. ..... 160/84.01
(58) Field of Search ..... 160/84.01, 178.2, 160/168.1 R, 330, 348

(56) References Cited

U.S. PATENT DOCUMENTS

| | | | | | |
|---|---|---|---|---|---|
| 4,926,605 | A | * | 5/1990 | Milliken et al. | 52/63 |
| 4,945,970 | A | * | 8/1990 | Marocco | 160/178.2 |
| 5,273,096 | A | * | 12/1993 | Thomsen et al. | 160/84.01 |
| 5,566,735 | A | * | 10/1996 | Jelic | 160/84.04 |
| 5,862,850 | A | * | 1/1999 | Yang | 160/84.04 |
| 6,257,300 | B1 | * | 7/2001 | Brownlie | 160/84.01 |

* cited by examiner

*Primary Examiner*—Blair M. Johnson
(74) *Attorney, Agent, or Firm*—Leong C. Lei

(57) ABSTRACT

A foldable window blind structure is disclosed. The window blind comprises a horizontal beam having a positioning device curtain cloth having an upper edge mounted at the bottom portion of the horizontal beam; a plurality of support rods mounted apart on the curtain cloth, wherein the support rod includes a back rod and a front rod, and one side of the back rod is provided with an engaging slot, and the top and bottom side of the back rod is provided correspondingly with an engaging slot, and the front rod is a side protrusion having engaging rib for mounting the curtain cloth at the engaging slot of the back rod; a plurality of suspension hook space apart mounted on corresponding position on the back rod, and one side of the suspension hook is a fastening section for mounting onto the engaging slot, and the other side of the suspension hook is provided with an insertion hole; a pulling rod having one end mounted to the suspension hook at the bottom portion support rod, and the other end passed through the suspension hook at various support rods and surrounded the top portion of the horizontal beam, and is passed out from the positioning device and vertically mounted at the front side of the curtain cloth, allowing the positioning device to control the elevating and lowering of curtain.

1 Claim, 9 Drawing Sheets

FOLDABLE WINDOW BLIND STRUCTURE

BACKGROUND OF THE INVENTION (a) Technical Field of the Invention

The present invention relates to window blind, and in particular, window blind structure which can be folded and facilitate cleaning and installation.

(b) Description of the Prior Art

FIGS. 9 and 13 show conventional window blind structure, and a common drawback of the structure is that the curtain cloth cannot be removed for cleaning. Further, the width of the folding of the curtain cloth cannot be adjusted and the curtain cannot be changed or replaced conveniently. When the curtains are polluted or dirty which required cleaning, the entire set has to be removed and it is a waste of material and money by discarding the curtain.

The conventional structure of the window blinds depicted in FIG. 13 employs a securing peg 80 to mount a support rod 81 onto a curtain 8, and the support rod 81 is disposed with a mounting hook 82 for the passage of a pulling rope 83, or using a mounting hook 91 having one end directly to fix the support rod 90 so that the rod 81 is secured to the curtain cloth 8,9, and the curtain cloth 8,9 is independent of the material. However, the securing peg 80 or the mounting hook 91 passes through the curtain cloth 8,9 and the cloth 8,9 may be destroyed or damaged. Besides, the installation is laborious and the width cannot be adjusted. Accordingly, it is an object of the present invention to provide a foldable window blind structure to mitigate the above drawbacks.

SUMMARY OF THE INVENTION

Accordingly, it is an object of the present invention to provide a foldable window blind structure comprising a horizontal beam having a positioning device; a curtain cloth having an upper edge mounted at the bottom portion of the horizontal beam; a plurality of support rods mounted apart on the curtain cloth, wherein the support rod includes a back rod and a front rod, and one side of the back rod is provided with an engaging slot, and the top and bottom side of the back rod is provided correspondingly with an engaging slot, and the front rod is a side protrusion having engaging rib for mounting the curtain cloth at the engaging slot of the back rod; a plurality of suspension hook space apart mounted on corresponding position on the back rod, and one side of the suspension hook is a fastening section for mounting onto the engaging slot, and the other side of the suspension hook is provided with an insertion hole; a pulling rope having one end mounted to the suspension hook at the bottom portion support rod ,and the other end passed through the suspension hook at various support rods and surrounded the top portion of the horizontal beam, and is passed out from the positioning device and vertically mounted at the front side of the curtain cloth, allowing the positioning device to control the elevating and lowering of curtain.

Yet another object of the present invention is to provide a foldable window blind structure wherein the suspension hook is formed from bending with steel wire having the end portion being bent to two fastening sections for the mounting of the engaging slot of the back rod, and the center section is bent side way to form a ring for the passage of the pulling rope.

Other objects, and advantages of the present invention can be more fully understood by reading the following detailed description of the preferred embodiment, with reference to the accompanying.

DETAILED DESCRIPTION OF THE PREFERRED EMBODIMENT

Figure 1:
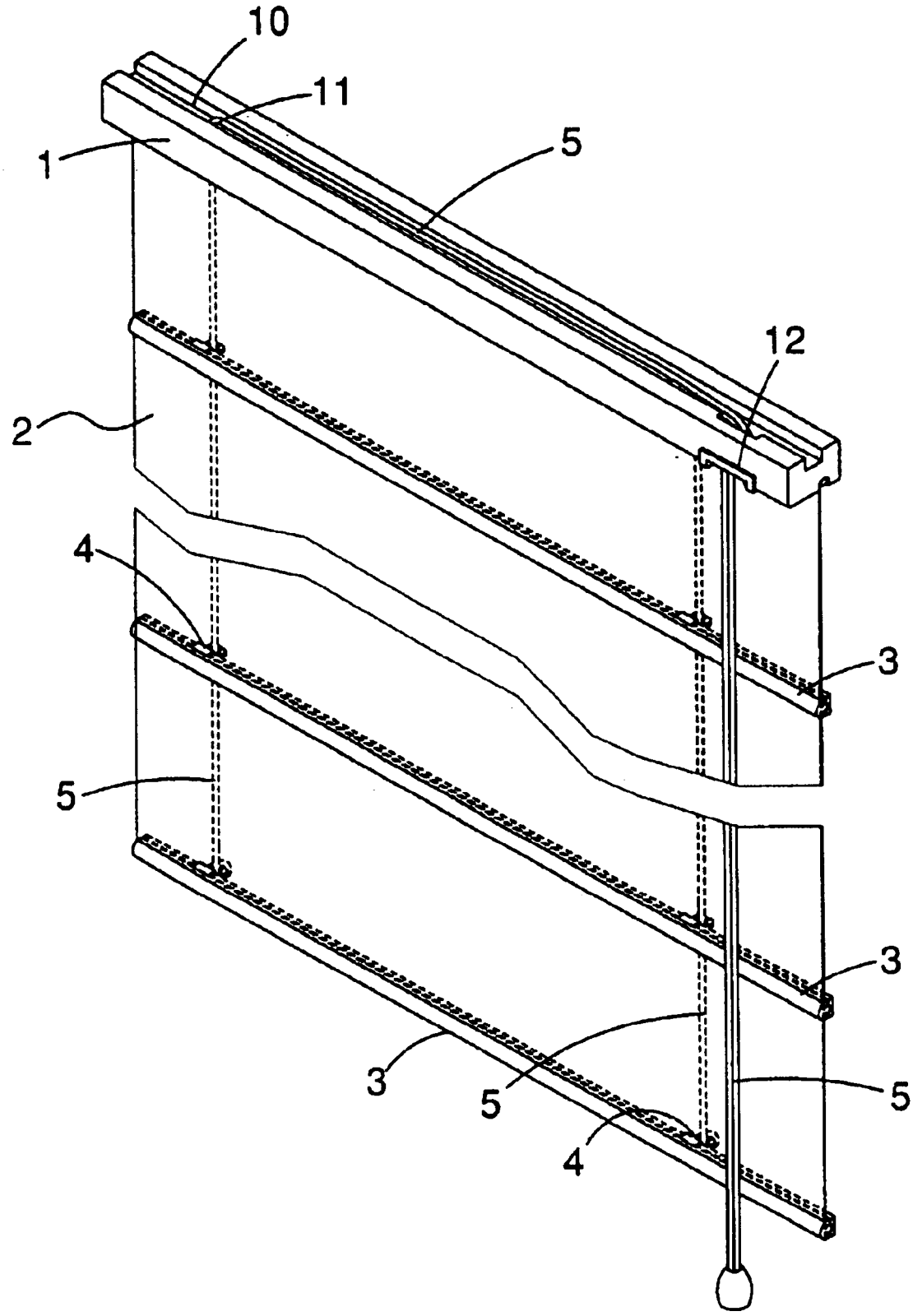
FIG. 1 is a perspective view of the present invention.
Figure 2:
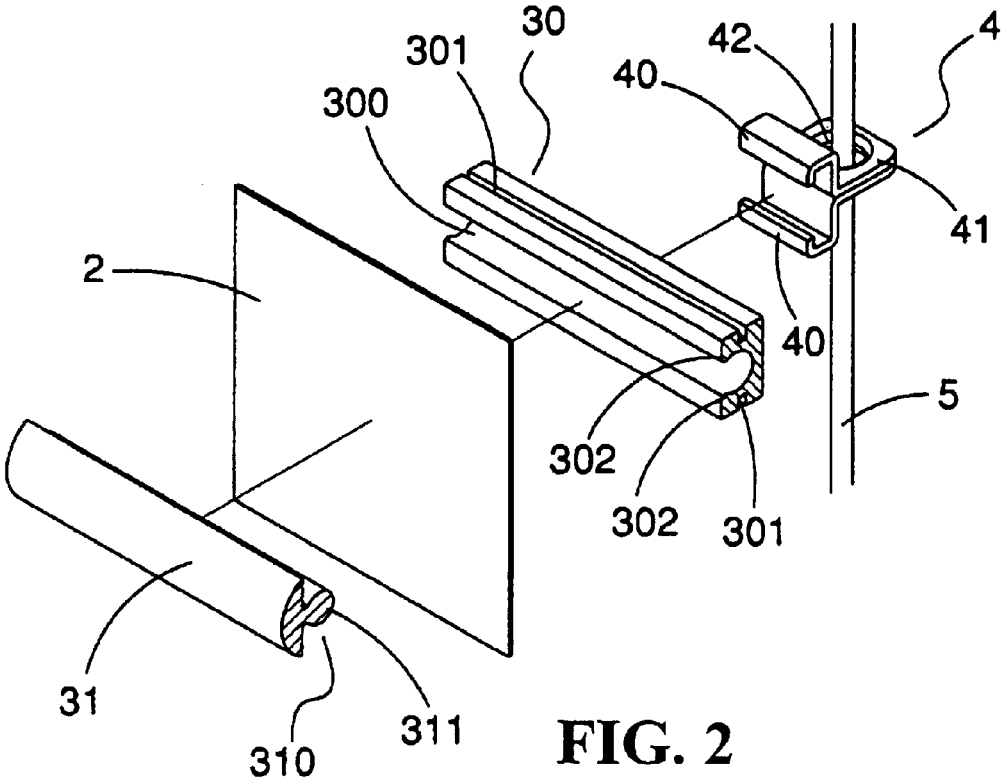
FIG. 2 is a partial exploded perspective view of the present invention.
Figure 3:
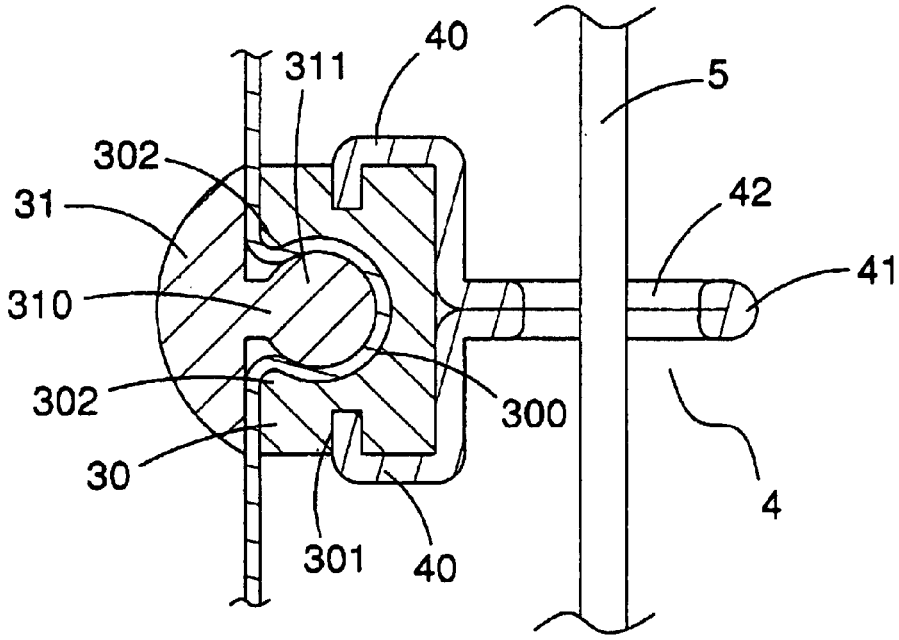
FIG. 3 is a partial sectional view of the present invention.
Figure 4:
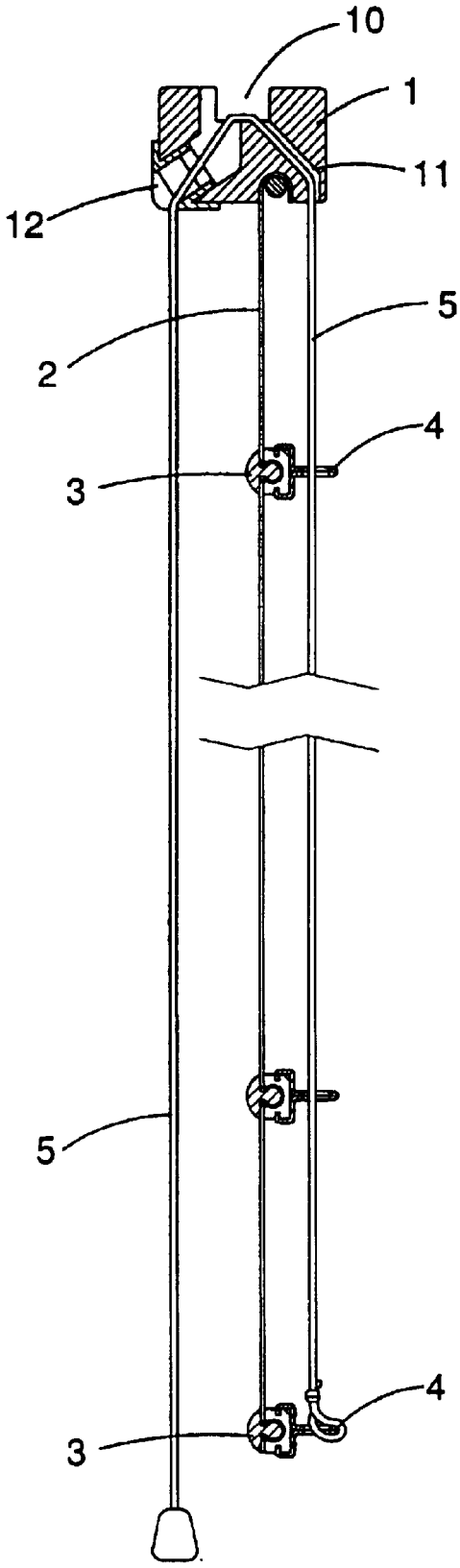
FIG. 4 is a sectional view of the present invention.

Referring to FIGS. 1 to 5, there is shown a window blind structure comprises a horizontal beam 1, a curtain cloth 2, a plurality of support rods 3, a plurality of suspension rings 4, and a pulling rope 5.

Figure 5:
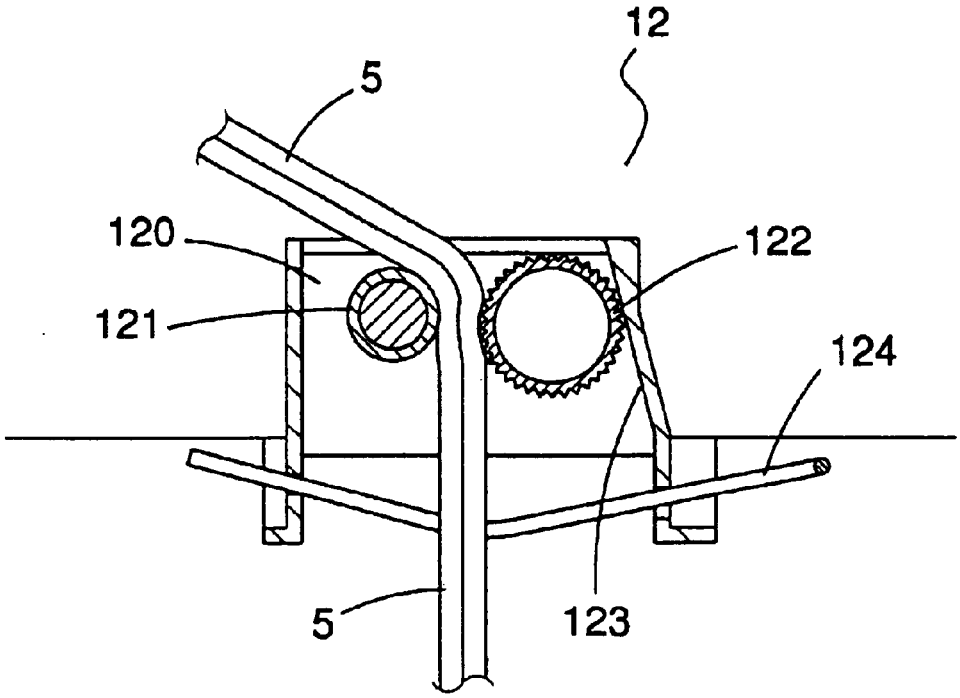
FIG. 5 is a sectional view of the positioning device of the present invention.

In accordance with the present invention, a horizontal beam 1 having a top section provided with a passage 10 with a plurality of through holes 11 from the top to the bottom section for the passage of the rope 5. The top of the horizontal beam 1 is provided with a positioning device 12. As shown in FIG. 5, the positioning device 12 is provided a cavity 120 passing through the bottom section of the horizontal beam 1 and the passage 10. The cavity 120 is provided with a securing pulley 121 and a freely moving engaging wheel 122 with ornament design on the surface thereof The cavity 120, urging one lateral wall of the engaging wheel is a slanting peg 123, and the bottom section of the cavity 120 is provided with an insertion peg 124 which can restrict the engaging wheel 122 at the cavity 120.

The curtain cloth 2 is made from fabric material or paper material and the upper edge is mounted at the bottom portion of the horizontal beam 1, and the surface of the curtain cloth 2 is provided with various types of patterns and stripes.

A plurality of support rods 3 are mounted apart on the curtain cloth 2, wherein the support rod 3 includes a back rod 30 and a front rod 31, and one side of the back rod 3 is provided with an engaging slot 300, and the top and bottom side of the back rod 3 is provided correspondingly with an engaging slot 301, and the front rod 31 is a side protrusion having engaging rib 31 for mounting the curtain cloth 2 at the engaging slot 300 of the back rod 3.

A plurality of suspension rings 4 spaced apart are mounted on corresponding position on the back rod 3, and one side of the suspension ring 4 is a fastening section 40 for mounting onto the engaging slot 301, and the other side of the suspension ring 4 is provided with an insertion hole 42.

The other side of the suspension ring 4 is provided with a protruded plate 41, and the protruded plate 41 is provided with an insertion hole.

A pulling rope 5 having one end is mounted to the suspension ring 4 at the bottom portion support rod 3, and the other end of the pulling rod 5 is passed through the suspension ring 4 at various support rods 3 and is surrounded the top portion of the horizontal beam 1, and is passed out from the positioning device 12 and vertically mounted at the front side of the curtain cloth 2, allowing the positioning device 12 to control the elevating and lowering of the curtain cloth 2.

Figure 6:
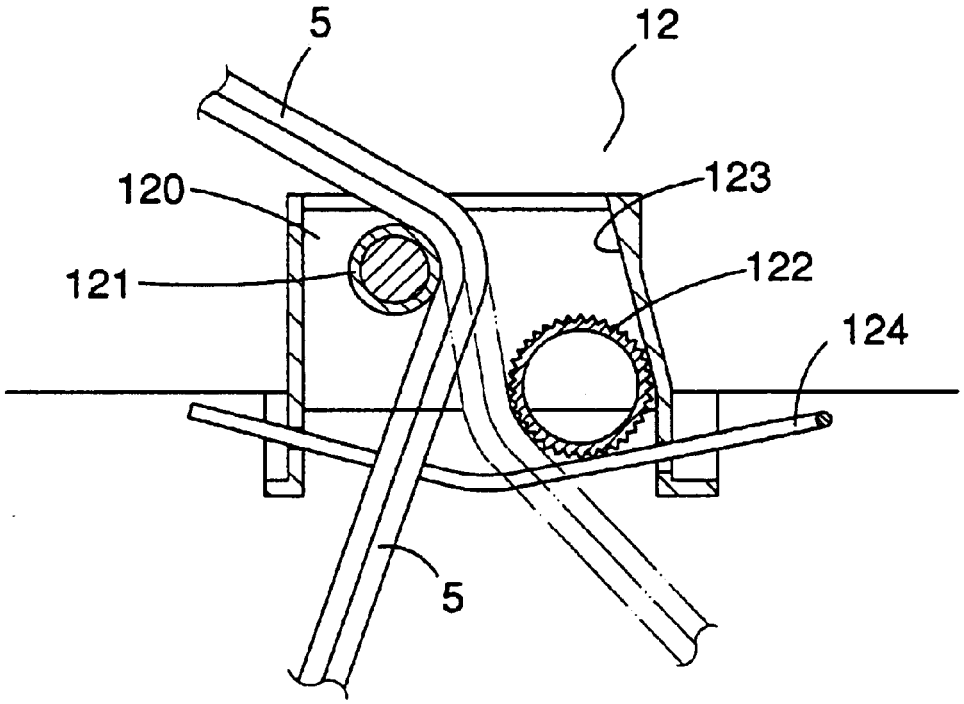
FIG. 6 is a schematic view showing the movement of the positioning device of the present invention.

Referring to FIG. 6, when the pulling rope. 5 is pulled inward with an angle downward, the engaging wheel 122 will be dislocated to the insertion peg 124 of the cavity 120. At this instance, the pulling rope 5 will disengage from the engagement of the engaging wheel 122 and the pulley 121, and the curtain cloth 2 is lifted up or down by means of the pulling force of the pulling rope 5 or the weight of the support rod 3. When the pulling rope 5 is pulled outward at an angle and is then released, one side of the pulling rope 5 will drive up the engaging wheel 122 by means of the frictional force produced by the engaging wheel, using the sloping face 123 of the cavity 120, the engaging wheel 122 is moved upward so as to clip the pulling rope 5 between the pulling 121 and the engaging wheel 122, providing the function of positioning, as shown in FIG. 5.

Figure 7:
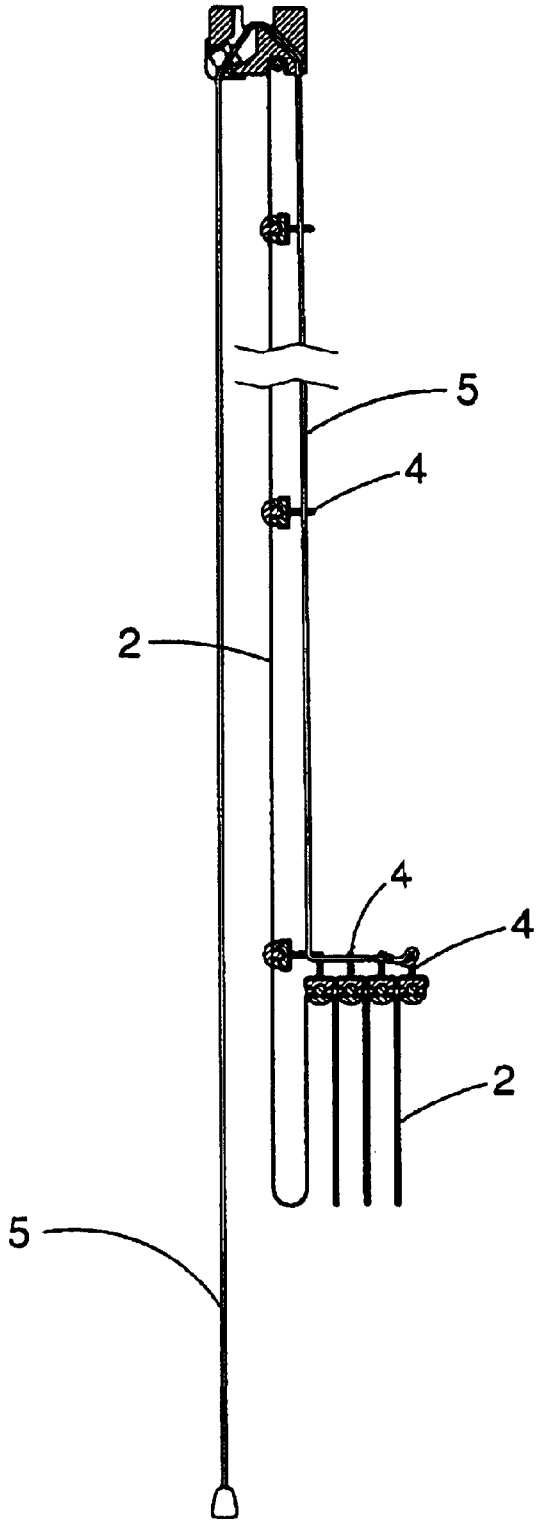
FIG. 7 is a schematic view showing the elevating and lowering movement of the present invention.

Referring to FIG. 7, when the pulling rope 5 is pulled downward, the suspension ring 4 at the bottom section will pull up the curtain cloth 2 at the bottom section, and in sequence, the suspension ring 4 is elevated by the upward movement of the lower suspension ring 4, such that the curtain cloth 2 between two adjacent support rods 3 will be folded in upward movement, vice versa, when the pulling rope 5 released, the curtain cloth 2 will be opened in sequence from the top, and the curtain cloth 2 will cover the window when the curtain cloth 2 moves downward.

The advantages of the present invention include:

(a) The curtain cloth will not be damaged due to the fact that the curtain cloth is clipped to the back rod and a front rod 31.

(b) The installation is simple, as an engaging rib 310 is used to press the curtain cloth 2 into the engaging slot 300 and the curtain cloth 2 will not be dislocated therefrom.

Therefore, the installation is simple.

(c) Mounting procedure is easily. The curtain cloth 2 can easily be mounted and therefore the curtain cloth 2 can be replaced frequently.

(d) A plurality of curtain material can be used. Due to the fact that the curtain cloth 2 is mounted by means of engaging the cloth 2 into an engaging slot, the spacing distance of the adjacent supports 3 can be adjusted so that the width of the folding is obtained accordingly.

(e) Cost saving. As the curtain cloth 2 can be removed for cleaning in case the cloth 2 is dirty. Therefore cost is saved in using the curtain cloth 2 of the present invention.

Figure 8:
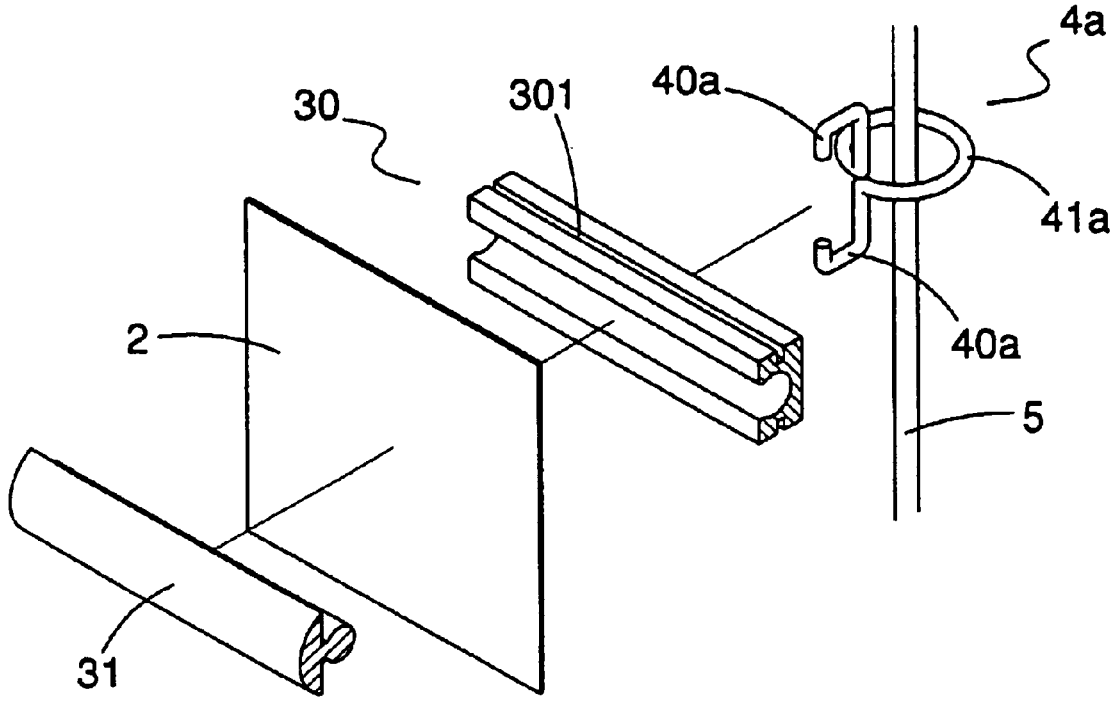
FIG. 8 is another preferred embodiment of a suspension hook formed by the bending of steel wire in accordance with the present invention.
Figure 9:
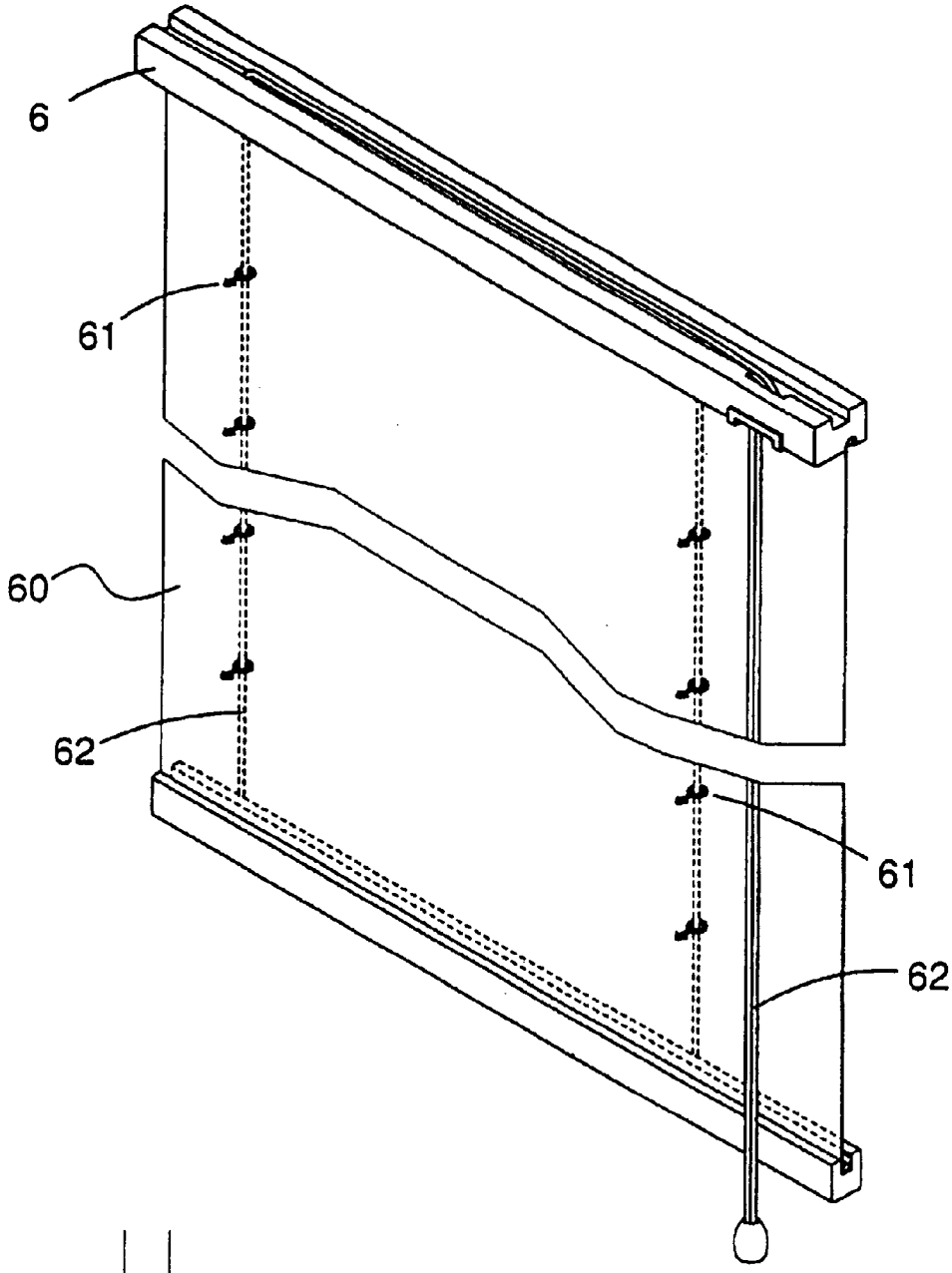
PRIOR ART FIG. 9
FIG. 9 is a perspective view of a conventional hook directly mounted to curtain cloth.
Figure 10:
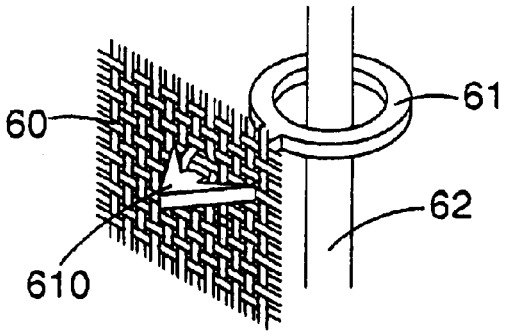
PRIOR ART FIG. 10
FIG. 10 is a partial enlarged view of FIG. 9.
Figure 11:
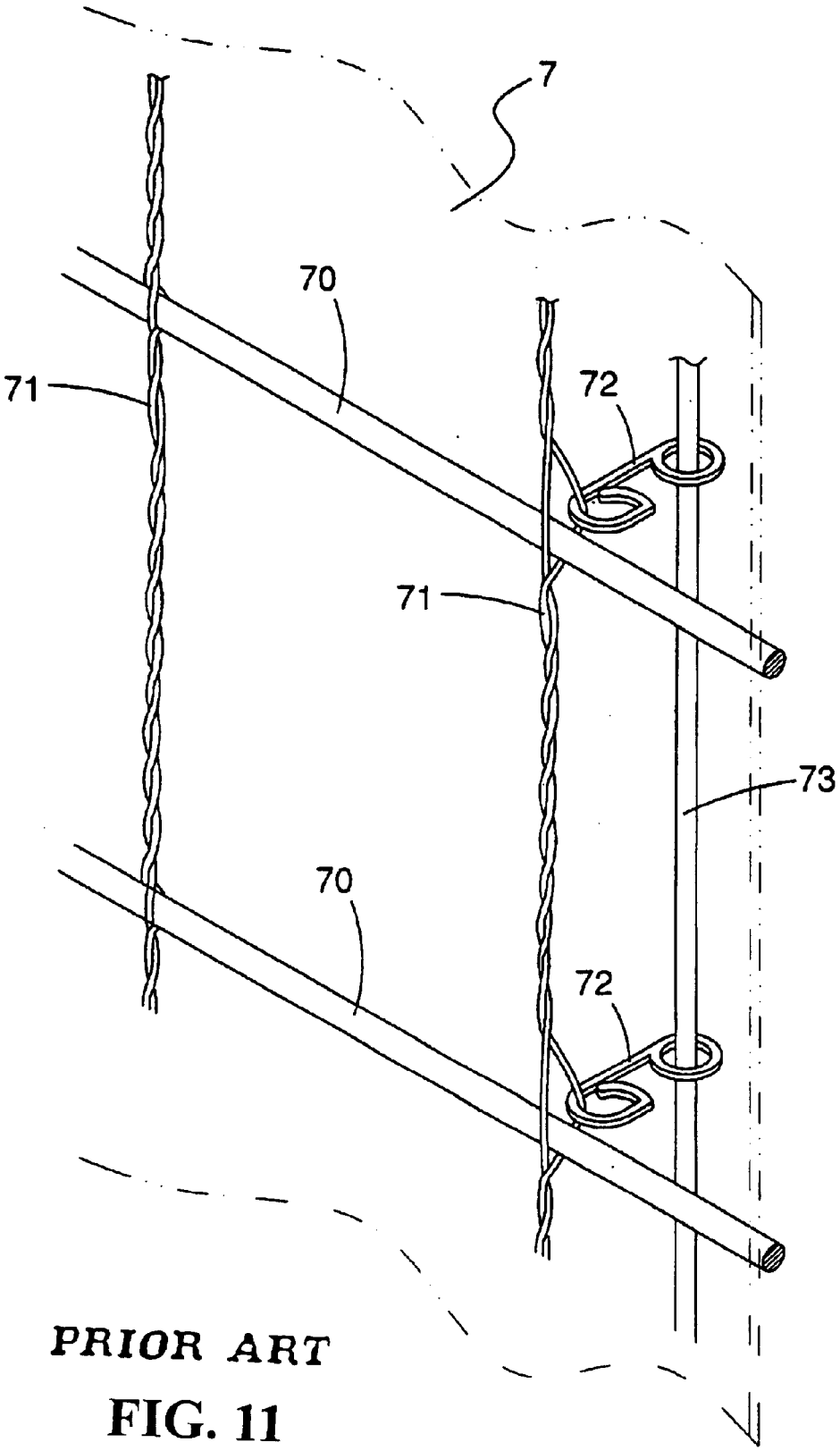
PRIOR ART FIG. 11
FIG. 11 is a partial perspective view showing conventional rope being used for mounting to a support rod.
Figure 12:
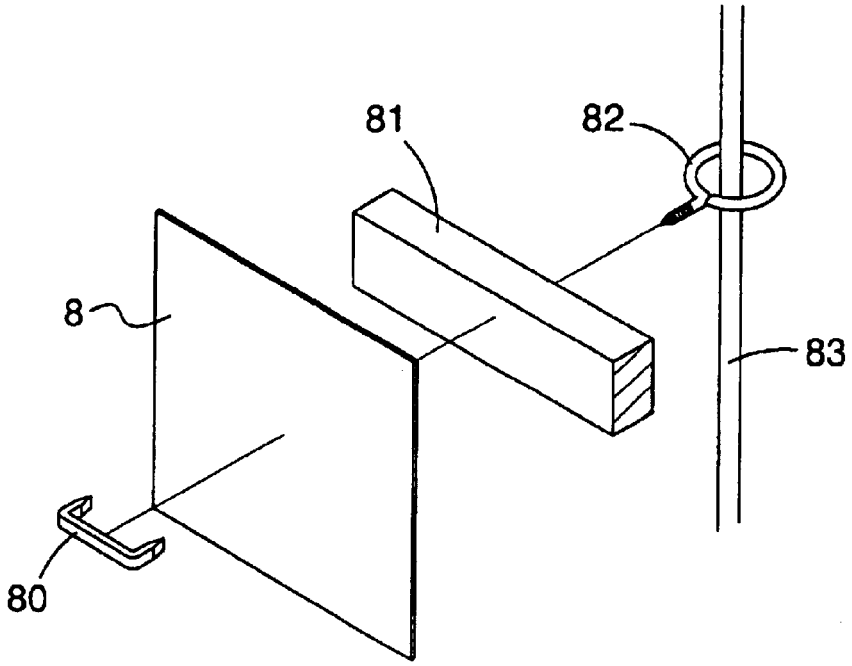
PRIOR ART FIG. 12
FIG. 12 is a partial exploded view using conventional securing peg to secure the support rod.
Figure 13:
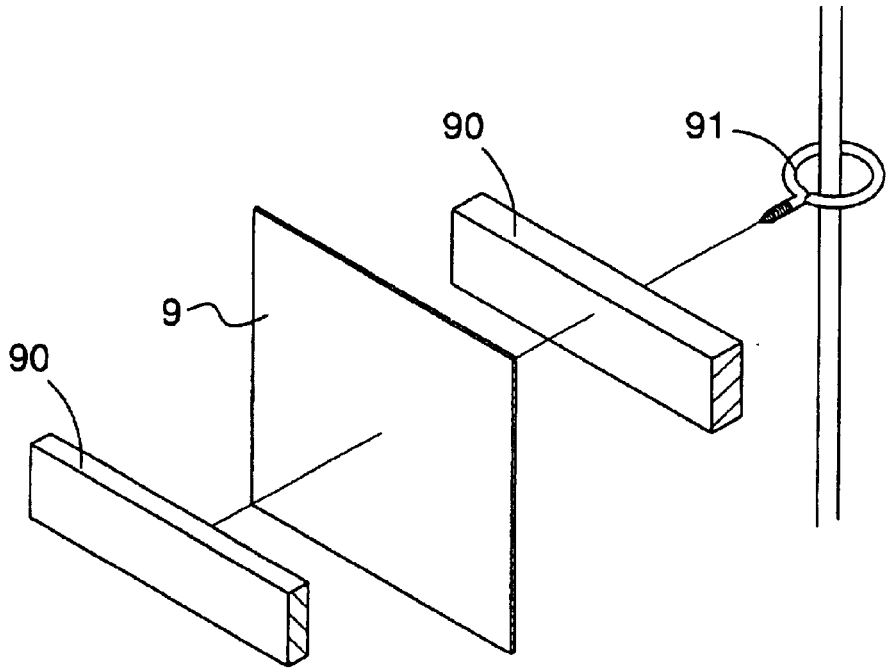
PRIOR ART FIG. 13
FIG. 13 is a partial exploded perspective view using conventional two support rods to clippingly support the curtain.

Referring to FIG. 8, the suspension hook 4*a* of the present invention is formed from a steel wire having an appropriate external diameter and the end thereof is bent into a fastening section 40*a* for engagement with the engaging slot 301 of the back rod 30. The center section of the steel wire has one side being bent to form a ring 41*a* for the passage of the pulling rope 5.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

We claim:

1. A foldable window blind structure comprising:

(a) a horizontal beam having a positioning device;

(b) a curtain cloth having an upper edge mounted at a bottom portion of the horizontal beam;

(c) a plurality of support rods mounted apart on the curtain cloth, wherein the each of the support rods includes a back rod and a front rod, and one side of the back rod is provided with an engaging slot, and a top and bottom side of the back rod is provided correspondingly with an engaging slot, and the front rod has a side protrusion having engaging rib for mounting the curtain cloth at the engaging slot of the back rod;

(d) a plurality of suspension rings spaced apart and mounted on corresponding position on the back rod, and one side of the suspension rings has a fastening section for mounting onto the engaging slot, and the other side of the suspension rings is provided with an insertion hole; and (e) a pulling rope having one end mounted to the suspension rings, and the other end of the pulling rope passing through the suspension rings at various support rods and surrounding a top portion of the horizontal beam, and passing out from a positioning device and vertically mounted at a front side of the curtain cloth, allowing the positioning device to control elevating and lowering of the curtain cloth;

wherein a top portion of the horizontal beam is provided with a channel having a plurality of through holes passing through a bottom section for passage of the pulling rope, and the positioning device has a cavity passing through a bottom section of the horizontal beam and the channel and the cavity is provided with a fixed pulley and a free engaging wheel and one lateral wall is provided with a slanting face and a bottom section of the cavity has a peg which restricts the engaging wheel at the cavity, the pulling rope passing through from a bottom thereof to the suspension rings to the through holes and surrounding the channel of the top portion of the horizontal beam and through the engaging wheel, and is mounted at one side of a front face of the curtain cloth, the suspension rings are formed from bending with steel wire having an end portion being bent to two fastening sections for mounting of the engaging slot of the back rod, and a center section is bent side way to form a ring for passage of the pulling rope.

* * * * *